United States Patent [19]

Ahlrich

[11] 4,018,578

[45] Apr. 19, 1977

[54] ELECTROSTATIC PRECIPITATOR

[76] Inventor: Willard K. Ahlrich, 321 N. Pine Lake Road, Stuart, Fla. 33484

[22] Filed: May 1, 1975

[21] Appl. No.: 573,570

[52] U.S. Cl. ..... 55/138; 55/149; 55/151

[51] Int. Cl.[2] ..... B03C 3/00

[58] Field of Search ..... 55/14, 120, 127, 129, 55/130, 136–138, 145, 148, 149, 406, 151

[56] References Cited

UNITED STATES PATENTS

| | | | |
|---|---|---|---|
| 1,343,285 | 6/1920 | Schmidt | 55/137 |
| 2,696,893 | 12/1954 | Richardson | 55/138 |
| 2,721,622 | 10/1955 | Ditzler | 55/138 |
| 2,776,724 | 1/1957 | Goldschmied | 55/138 |
| 2,871,974 | 2/1959 | Werst | 55/137 |

FOREIGN PATENTS OR APPLICATIONS

| | | | |
|---|---|---|---|
| 620,108 | 1/1927 | France | 55/401 |
| 846,522 | 8/1960 | United Kingdom | 55/138 |
| 995,230 | 6/1965 | United Kingdom | 55/120 |

*Primary Examiner*—Bernard Nozick
*Attorney, Agent, or Firm*—Woodhams, Blanchard and Flynn

[57] ABSTRACT

An electrostatic precipitator having a rotor supported for rotation within a housing containing inlet and outlet openings adjacent the opposite ends thereof. The rotor is formed by a plurality of ringlike collector plates which are fixedly connected in parallel but axially spaced relationship. One end of the rotor, which is closed by a support plate, is disposed adjacent the outlet opening. The collector plates are alternately of opposite charge to create electrostatic fields therebetween to remove ionized particles from the gas which flows radially outwardly between the plates during rotation of the rotor. The collector plates have aligned central openings which decrease in diameter towards the closed end of the rotor. The outside diameter of the collector plates also decrease in diameter towards the closed end of the rotor, whereby the collector plates all substantially equal surface areas acted upon by the electrostatic field. An ionizing device is disposed across the inlet opening for ionizing the foreign particles entrained in the gaseous stream which flows through the inlet opening into the rotor.

9 Claims, 10 Drawing Figures

ELECTROSTATIC PRECIPITATOR

FIELD OF THE INVENTION

This invention relates to an air cleaning system and, in particular, to an improved electrostatic precipitator for removing foreign particles from gases, such as air.

BACKGROUND OF THE INVENTION

Electrostatic precipitators utilizing a plurality of axially spaced collector plates, which plates are alternately of opposite charge, have been used for removing dust and other foreign particles from gases, such as air. Conventional precipitators, as disclosed in U.S. Pat. Nos. 3,871,974 and 2,776,724, have employed collector plates of equal outside diameter, which plates have central openings which are either of equal diameter or are of progressivley decreasing diameter. While these precipitators have been partially effective in removing foreign particles from gases, nevertheless they have not removed foreign particles with the speed and efficiency required to permit the mass handling of large quantities of highly contaminated gases per unit time.

In studying these known precipitators, it was discovered that one of the primary problems was the nonuniformity of flow between the plural pairs of oppositely charged collector plates, and the nonuniformity of the collection capability of the various pairs of oppositely charged plates. Since the plates are axially spaced along the precipitator, and inasmuch as the inflowing air is supplied axially into one end of the precipitator so that it must be turned to flow radially outwardly between the plates, the air does not flow equally between all of the adjacent pairs of plates. Rather, substantially greater quentities of air flow between the plates adjacent the closed end of the precipitator in contrast to the amount of air which flows between the plates adjacent the inlet end. Thus, only a small portion of the axial length of the precipitator operates at maximum efficiency, so that maximum flow rate and particle removal capacity of the precipitator is severely limited.

To correct this nonuniform flow between the adjacent plates, it has been proposed to form the plates with progressively decreasing central openings so that the precipitator has a central gas-receiving space which is of a tapered and converging configuration. While this does tend to equalize, or at least make more uniform, the flow rate of gas between the adjacent pairs of plates, nevertheless this configuration results in the plates adjacent the closed end of the precipitator being of greatly increased surface area in contrast to the plates adjacent the inlet end. Since the same potential difference is applied across each pair of adjacent plates, electrostatic fields of different intensity are created throughout the length of the precipitator. Further, these larger area plates are believed to result in increased turbulence when the air flows between the plates, which turbulence reduces the particle removal efficiency.

Accordingly, the present invention relates to an improved electrostatic precipitator having a plurality of axially spaced plates which are alternately charged to form electrostatic fields therebetween, which plates are of a ringlike configuration and have inner diameters which, either progressively or in a steplike manner, are of decreasing diameter so that the central gas-receiving space is of decreasing diameter to result in substantially uniform flow of gas radially outwardly between the oppositely charged pairs of plates. The outer diameter of the plates are also of decreasing diameter, either progressively or in a steplike manner, as the plates extend toward the closed end of the precipitator so that all of the collector plates are of substantially equal surface area, whereby a substantially uniform electrostatic field is created between each pair of adjacent plates.

Another object of the present invention is to provide a precipitator, as aforesaid, wherein the collector plates are formed as a rotor which is rotatably driven to assist in causing the air to flow outwardly between the plates due to centrifugal force, which centrifugal force also assists in removing the collected masses of solid particles from the plates to assist in keeping the plates clean.

It is also an object of the present invention to provide an improved precipitator, as aforesaid, which can be manufactured and assembled in an economical manner, requires a minimum number of different plate sizes, is durable in operation, permits the flow therethrough of large quantities of gas per unit time, and can be operated by a minimal amount of energy.

Other objects and purposes of the present invention will be apparent to persons acquainted with devices of this type upon reading the following specification and inspecting the accompanying drawings.

Figure 1:
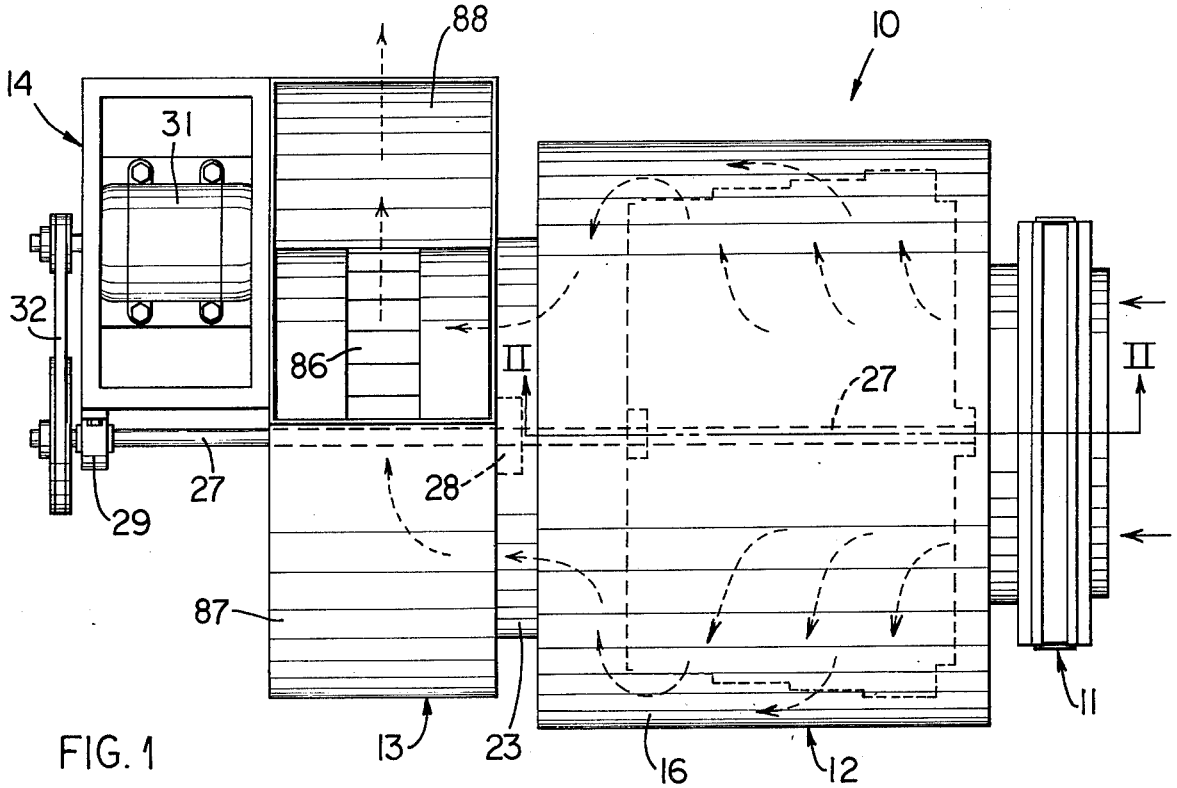
FIG. 1 is a top view of an air cleaning system according to the present invention.

Certain terminology will be used in the following description for convenience in reference only and will not be limiting. For example, the words "upwardly," "downwardly," "rightwardly," and "leftwardly" will refer to directions in the drawings to which reference is made. The word "forwardly" will refer to the normal flow directions of gas through the cleaning system and through the precipitator, which normal flow direction occurred from right to left in FIGS. 1 and 2. The words "inwardly" and "outwardly" will refer to directions toward and away from, respectively, the geometric center of the device and designated parts thereof. Said terminology will include the words above specifically mentioned, derivatives thereof and words of similar import.

SUMMARY OF THE INVENTION

The objects of the present invention are met by providing an electrostatic precipitator which includes a substantially cylindrical housing having inlet and outlet openings at opposite ends thereof. A precipitator rotor is disposed within the housing and is rotatable about the longitudinal axis of the housing. The rotor is formed by a plurality of axially spaced, ringshaped collector plates which are fixed together to define a plurality of narrow channels which open radially outwardly between adjacent plates. The plates are alternately of opposite electrical charge so that an electrostatic field is created between each adjacent pair of plates. The plates have aligned central openings therein which are of decreasing diameter, either progressively or in a steplike manner, as the plates extend toward the outlet opening. However, the end of the rotor disposed adjacent the outlet opening is closed to force the air to flow radially outwardly through the electrostatically charged channels. The outer diameters of the collector plates are also of decreasing diameter, either progressively or in a steplike manner, as the plates extend toward the closed end of the rotor. The collector plates are all of substantially equal surface area so that substantially equal electrostatic fields are created between each pair of oppositely charged plates. An ionizing device is disposed adjacent the inlet end of the precipitator to cause foreign particles in the inflowing gases to be positively charged. The gases flow into the central opening of the rotor and, due to the closed end of the rotor and due to centrifugal force, flow outwardly between the collector plates whereupon the positively charged foreign particles are collected on the surfaces of the negatively charged or grounded collector plates.

DETAILED DESCRIPTION

FIG. 1 illustrates a cleaning system 10 for removing dust and other solid particles from gases, such as air, which system includes an ionizing device 11, an electrostatic precipitator 12, a centrfugal blower 13 and a driving device 14.

Figure 2:
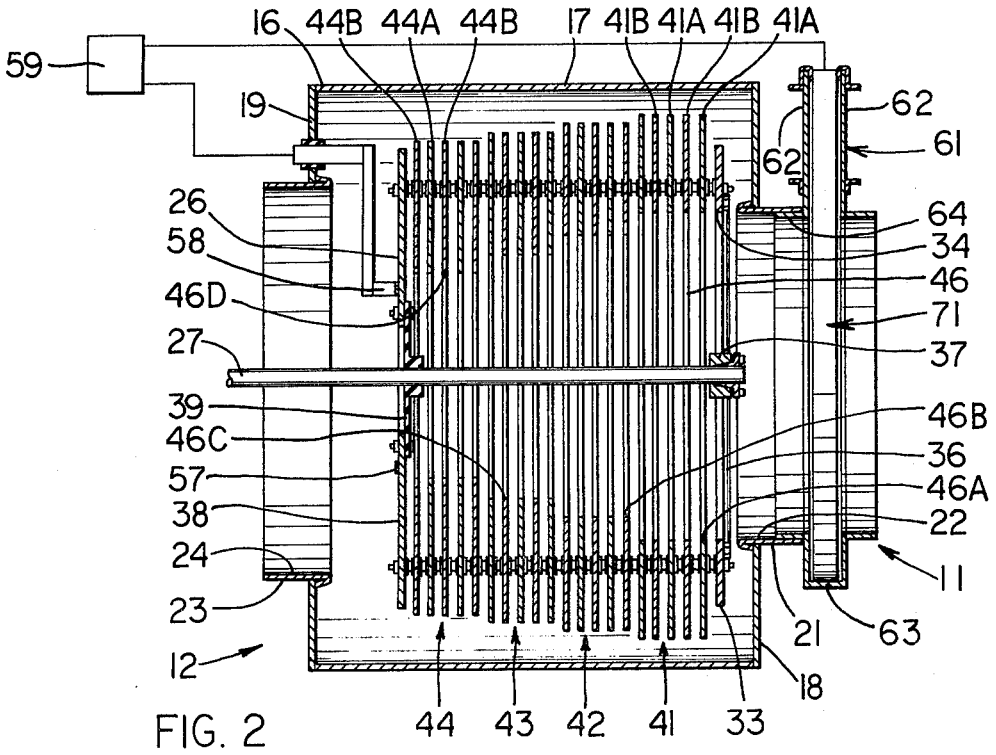
FIG. 2 is a cross-sectional view of the electrostatic precipitator as taken along the line II—II in FIG. 1.
Figure 3:
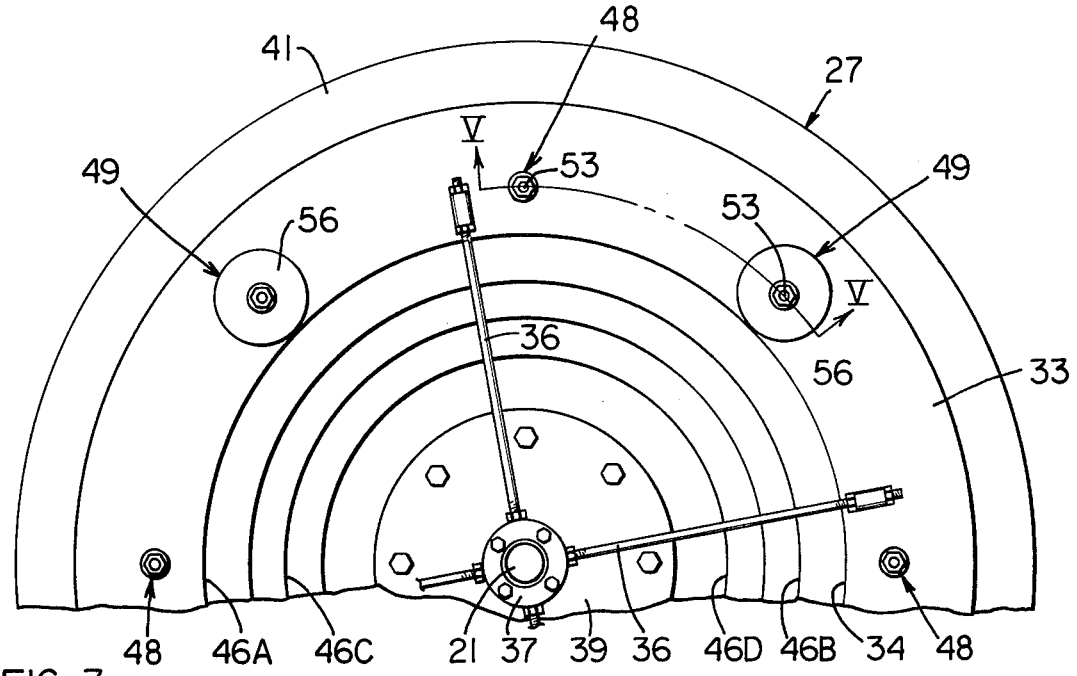
FIG. 3 is an enlarged, fragmentary end view of the precipitator rotor.

The electrostatic precipitator 12, as illustrated in FIG. 2, includes a cylindrical housing 16 formed by an annular sidewall 17 and spaced end walls 18 and 19. An annular collar 21 is mounted on end wall 18 concentric with the housing and defines an inlet opening 22. A further annular collar 23 is mounted on end wall 19 so as to define an outlet opening 24, which is coaxially aligned with the opening 22.

A precipitator member or rotor 26 is secured to a shaft 27 for rotation therewith, which shaft 27 extends through the blower 13 and is rotatably supported by bearings 28 and 29. Bearing 28 is located adjacent the discharge end of the precipitator 12 so that rotor 27 and the projecting portion of shaft 27 are supported in cantilever fashion within the housing 16. The shaft 27 is aligned with the axis of the cylindrical housing 16 so that the rotor 26 is concentric therewith.

Shaft 27 is driven by the driving device 14 which, as illustrated in FIG. 1, includes a conventional electric motor 31 drivingly interconnected to the shaft 27 by any suitable device, such as a belt transmission 32.

The rotor 26 incudes an annular support plate 33 disposed adjacent the inlet end of the precipitator, which plate 33 is positioned closely adjacent the end wall 18 and has an opening 34 formed therein which is aligned with and of substantially the same diameter as the inlet opening 22. The outer ends of a plurality of rodlike spokes 36 are fixed to the support plate 33, which spokes 36 project radially inwardly and have their inner ends fixed to a support hub 37 which is fixed to the forward end of the shaft 27.

A further annular support plate 38 is disposed adjacent the other end of the rotor 26 and includes a central hub member 39 which is fixed to the shaft 27 and closes the rearward end (leftward end in FIG. 2) of the rotor. Hub member 39 is of an electrical insulating material for a purpose which will be apparent hereinafter. The support plates 33 and 38 are disposed in axially spaced but parallel relationship to one another and are each fixed to the shaft 27 for rotation therewith. The plate 38 is, as illustrated in FIG. 2, spaced forwardly from the outlet opening 24.

Rotor 26 includes, in the space between the support plates 33 and 38, a plurality of circular ring-shaped collector plates disposed concentric to and axially spaced along the shaft 27. As illustrated in FIG. 2, the rotor includes a plurality of different sets of collector plates, there being four sets 41, 42, 43 and 44 in the illustrated embodiment, with each set including a plurality of identical plates, there being five plates in each set of the illustrated embodiment. The plates of the individual sets 41–44 are defined by an outside diameter which progressively decreases in the axial direction of the rotor, and similarly the plates of the individual sets 41–44 are also defined by an inside diameter which progressively decreases in the axial direction of the rotor. For example, the outside diameter of the plates 41 is greater than the outside diameter of the plates 42, which plates 42 have an outside diameter greater than the outside diameter of the plates 43, which plates 43 in turn have an outside diameter greater than the outside diameter of the plates 44. Further, the inside diameter or opening 46A in the plates 41 is greater than the opening 46B in the plates 42, which opening 46B is greater than the opening 46C in the plates 43, and the openings 46C is greater than the opening 46D in the plates 44. The opening 46A–46D thus define an axially elongated gas-receiving space 46 which is of a stepped configuration so as to be of progressively decreasing diameter, whereby the space 46 roughly approximates a conical configuration.

According to the present invention, the steplike decrease in the inner and outer diameters results in all of the plates 41–44 being of substantially the same surface area.

Each of the plates 41–44 is maintaihed in a fixed and concentric relationship relative to the shaft 27, with the individual plates being spaced a uniform distance apart. Plates 41–44 are fixedly maintained in this desired relationship by a plurality of tie rod assemblies 48 and 49 which extend between the support plates 33 and 38. In the illustrated embodiment, there are four identical tie rod assemblies 48 which are equally angularly spaced from one another on a circular pattern concentric with the axis of the shaft 27. There are also four identical tie rod assemblies 49 which are equally angularly spaced on a circular pattern concentric with the shaft 27, which tie rod assemblies 49 are disposed midway between and on the same circular pattern as the assemblies 48.

Figure 4:
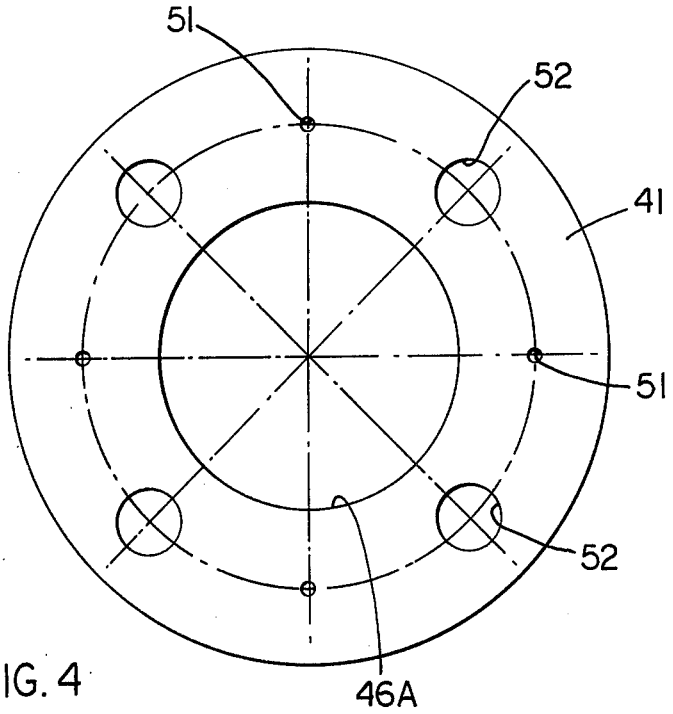
FIG. 4 is a view of one of the collector plates.

To permit the individual collector plates to accommodate the tie rod assemblies 48 and 49, each collector plate, such as the plate 41 illustrated in FIG. 4, has a set of four small diameter openings 51 formed therethrough, and a set of four large diameter openings 52 formed therethough, which openings 51 and 52 ae equally angularly spaced from one another so that the individual openings of one set are disposed between a pair of openings of the other set. The openings 51 and 52 are all equally radially spaced from the axis of the collector plate. The support plates 33 and 38 also have identical sets of openings 51 and 52 formed therethrough.

Figure 5:
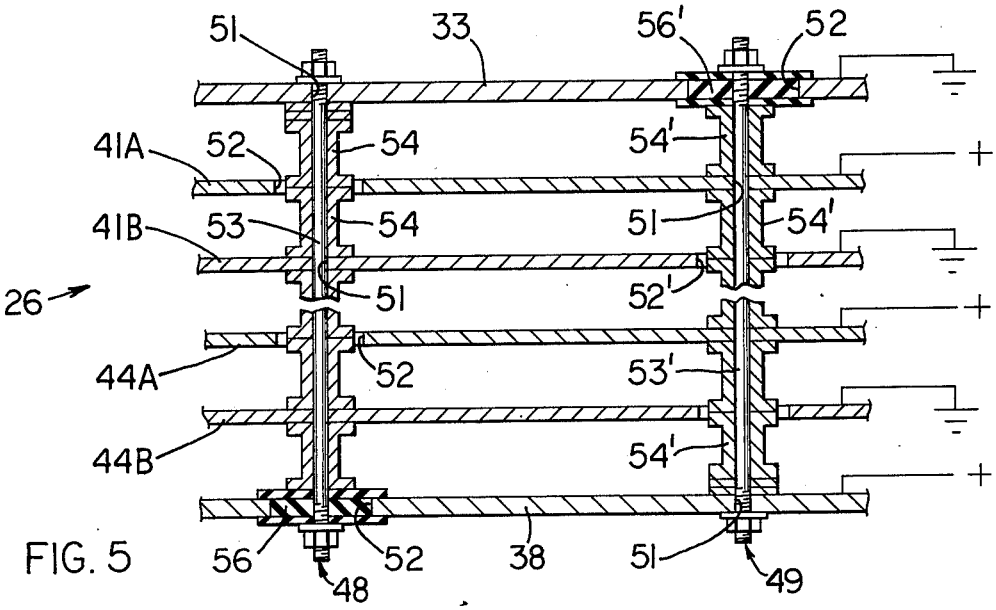
FIG. 5 is a fragmentary sectional view taken along the line V—V in FIG. 3.

As illustrated in FIG. 5, the collector plates 41–44 are disposed so that the openings 51 and 52 as formed in adjacent plates are disposed in alignment with one another. That is, the openings 51 and 52 as formed in the endmost collector plate 41A are disposed so as to respectively align with the openings 52 and 51 formed in the next adjacent collector plate 41B. The openings 52 and 51 in collector plate 41B are then disposed so as to respectively align with the openings 51 and 52 in the next adjacent collector plate. This alternating sequence is repeated throughout the complete length of the rotor.

The aligned openings 51 and 52 accommodate therein an elongated tie bolt 53 which is associated with the tie rod assembly 48, which tie bolt extends through the aligned openings 51 and 52 formed in the collector plates and also extends through the opening 51 in the support plate 33 and the opening 52 in the support plate 38. A plurality of spool-shaped spacer sleeves 54 are disposed in snug surrounding relationship to the tie bolt 53, which spacer sleeves snugly clamp the alternate collector plates 41B–44B relative to the tie bolt assembly 48 and relative to the support plates 33 and 38. For example, two spacer sleeves 54 axially abut one another and extend between and engage the support plate 33 and the second collector plate 41B, which collector plate 41B is snugly engaged on the opposite sides thereof by a pair of opposed spacer sleeves 54. The abutting ends of the spacer sleeves 54 extend through the enlarged opening 52 formed in the intermediate collector plate 41A. By use of the intermediate spacer sleeves 54, and by the altering relationship of the small and large diameter openings 51 and 52, every other collector plate is thus clampingly engaged relative to one another and relative to the support plates 33 and 38. The collector plates, the support plate 33 and the spacer sleeves 54 are all constructed of an electrically conductive material. The support plate 33 is also connected to the shaft 27 which functions as a ground or negative terminal for the precipitator. Further, the lower end of the bolt 53 is connected to support plate 38 by means of an intermediate electrically insulating spacer 56 which is disposed in the opening 52. Thus, the support plate 33 and every other collector plate (that is, plates 41B–44B) are grounded.

The remaining alternately positioned collector plates, which have been designated by the addition of an A thereto, are maintained in a fixedly clamped relationship relative to the rotor by means of the tie rod assemblies 49. The tie rod assembly 49 also includes an elongated tie bolt 53′ which extends through the alternately aligned openings 51 and 52 in the collector plates, with one end of the tie bolt 53 extending through the large opening 52 formed in the support plate 33 while the other end of bolt 53 extends through the small opening 51 in plate 38. The ends of the bolt 53′ are suitably connected to the support plates 33 and 38, with the upper end being electrically insulated from plate 33 by means of insulating member 56′ which is accommodated within the opening 52. The tie bolt 53′ also snugly accommodates thereon a plurality of spool-shaped spacer sleeves 54′ which coact with the collector plates for fixedly clamping the alternate plates 41A–44A together, which spacers 54′ extend through the enlarged openings 52 formed in the grounded plates 41B–44B. The plates 41A–44A are thus electrically interconnected while being electrically isolated from the plates 41B–44B.

The support plate 38 is electrically energized by a positive direct-current potential and, for this purpose, the plate 38 is provided with an electrically conductive slipring 57 thereon. Ring 57 is disposed in slidable engagement with an electrical slip contact 58 which is mounted on the precipitator housing and is energized from a conventional D.C. power source 59. Thus, the alternate plates 41A–44A are electrically energized by means of a direct current potential, whereas the intermediate collector plates 41B–44B are grounded. Thus, an electrostatic field is generated between each adjacent pair of plates.

Since the collector plates are all of substantially the same surface area, as noted above, the electrostatic fields as generated between the adjacent pairs of collector plates are of substantially equal intensity throughout the axial length of the rotor 26.

Figure 6:
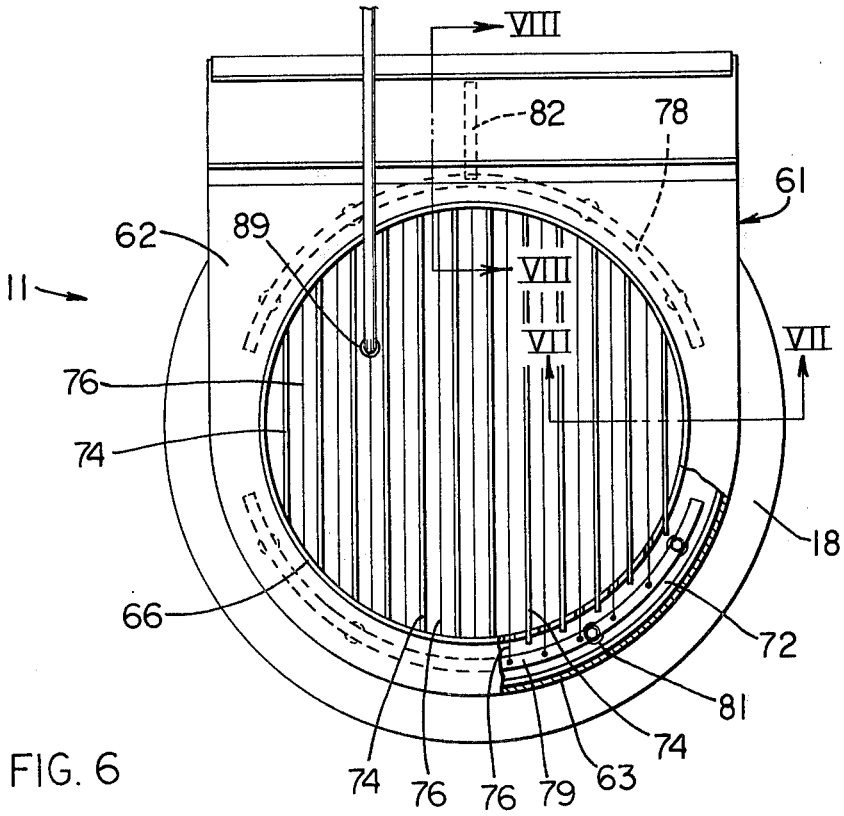
FIG. 6 is an elevational view of the rightward end of the device as illustrated in FIG. 2.
Figure 7:
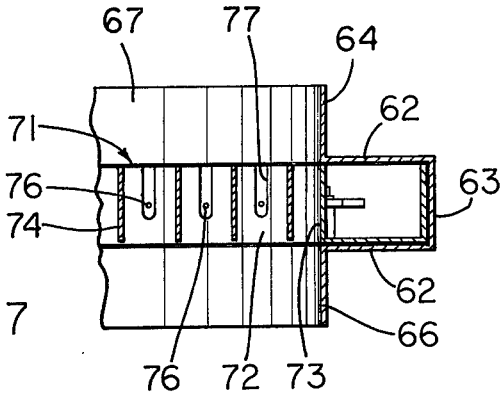
FIG. 7 is an enlarged, fragmentary cross-sectional view taken along the line VII—VII in FIG. 6.
Figure 8:
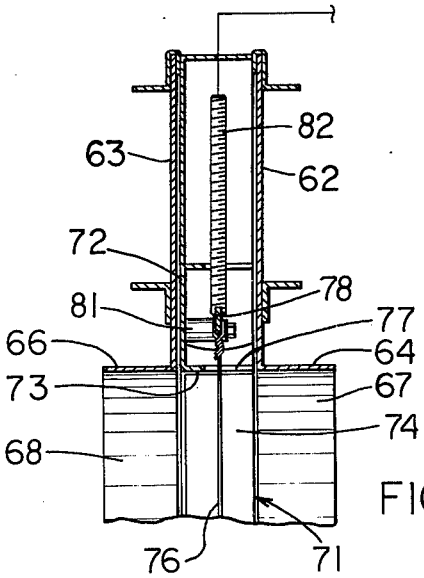
FIG. 8 is an enlarged, fragmentary cross-sectional view taken along the line VIII—VIII in FIG. 6.

Considering now the ionizing device 11, and referring specifically to FIGS. 6–8, same includes a housing 61 formed by a pair of parallel sideplates 62 connected by an edge plate 63. Annular collars 64 and 66 are fixed to the sideplates 62 and define therein inlet and outlet openings 67 and 68, respectively. The collar 66 is received within the collar 21 formed on the precipitator housing 16 so that the ionizing device 11 is aligned with the inlet opening of the precipitator 12.

The housing 61 accommodates therein an ionizer 71 which is formed by a ringlike member 72 which is of a forwardly facing channel-shaped cross section as illustrated in FIG. 8. The ringlike member 72 defines therein an annular opening 73, and a plurality of parallel divider plates 74 extend across the opening 73 and have their opposite ends mounted on the ring member 72. A plurality of ionizing wires 76 also extend across the opening 73, with each ionizing wire 76 being disposed parallel to and uniformly spaced between an adjacent pair of plates 74. The ends of the ionizing wires 76 extend through slots 77 formed in the inner leg of the channel-shaped ring member 72, with the wires 76 being anchored to elongated arcuate conductive strips 78 and 79. The strips 78 and 79 are supported on ring member 72 by electrical insulators 81. A terminal member 82 is also connected to the conductive strip 78, which terminal member 82 is electrically connected to the D.C. power pact 59 for permitting energization of the ionizing wires 76. The wires 76, by being uniformly spaced between parallel plates 74, create an electrostatic field between the ionizing wires and the divider plates.

The gases are drawn into and through the ionizing device 11 and the electrostatic precipitator 12 by means of the blower 13 which may be of any conventional configuration. In the illustrated embodiment, the blower 13 includes a conventional blower wheel 86 disposed within a housing 87 and secured to the shaft 27 for rotation therewith. The blower wheel has an axially directed inlet opening which communicates and is aligned with the precipitator. The blower wheel which causes the gases to be discharged through a discharge opening 88 for supply to a further conduit (not shown) or for discharge into the surrounding atmosphere.

OPERATION

When the air cleaning system is to be operated, the ionizing wires 76 are energized by the D.C. power pack 59, which power pack also energizes the alternate collector plates, 41A, 42A, 43A and 44A. This results in electrostatic fields between the ionizing wires 76 and the divider plates 74, and between the adjacent collector plates such as 41A–41B.

When motor 31 is energized, the blower wheel 86 and the precipitator rotor 26 are simultaneously rotated. The blower wheel 86 causes gases or air with dust and other contaminating particles therein to be drawn through the ionizing device 11, whereupon the air passes through the electrostatic fields created between the wires 76 and the plates 74. This causes ionization of the air so that the foreign particles entrained in the air are given a positive electrostatic charge. The air then flows into the elongated space 46 formed within the rotor 26 and, due to the suction created by the blower wheel 86, and due also to the centrifugal effect created by rotation of the rotor, the air within space 46 flows radially outwardly through the narrow channels defined between the collector plates, which channels are acted upon by an electrostatic field. Since the foreign particles in the air were previously positively charged by the ionizing device 11, these particles collect on the surfaces of the grounded or negatively charged plates 41B–44B as the air flows outwardly between the collector plates. The resulting clean air is then deflected axially of the housing 16 and flows through the discharge opening 24 so as to be supplied to the inlet of the blower 13.

Since the central openings 46A–46D of the collector plates are of progressively decreasing diameter, the thus-formed space 46 functions in a manner similar to a conical opening in that the resistance to flow in the axial direction of the space 46 increases as the inflowing air approaches the closed end (leftward end in FIG. 2) of the rotor. The increased resistance caused by the decreasing diameter of the space 46 causes substantially equal volumes of air to be radially discharged outwardly between each pair of collector plates along the axial length of the rotor. Further, since each collector plate has substantially the same surface area, the electrostatic field between each adjacent pair of plates is substantially the same throughout the axial length of the rotor, so that each adjacent pair of collector plates is thus equally effective in removing foreign particles from the air.

By positioning the ionizing wires 76 in a plane transverse to the inflowing air stream, and by utilizing a plurality of such wires 76 disposed midway between the divider plates 74, the foreign particles within the air are easily and efficiently ionized so as to permit efficient and rapid removal of the foreign particles when the air flows outwardly between the alternately charged collector plates.

The foreign particles which collect on the negative or grounded collector plates 41B–44B collect on these plates until they form small globular masses which, due to centrifugal force, slowly slide radially outwardly along the collector plates until the masses are discharged tangentially from the plates. The discharged masses are collected within the housing 16, from which they are periodically removed by cleaning the housing with steam, warm water or other suitable cleaning solutions. For this purpose, a spray nozzle 89 can be disposed directly adjacent the inlet end of the ionizing device 11, which nozzle can be used for spraying a stream of steam or other cleaning solution through the divider plates and into the rotor, whereupon the cleaning solution can be centrifugally discharged outwardly through the rotor for cleaning the rotor and the interior of the housing. A suitable drain (not shown) is provided in the bottom of the precipitator housing to permit the cleaning solution and the collected solid mass to be suitably discharged.

In the present invention, a potential of between 12 and 16 kilovolts, and preferably 14 kilovolts, is applied to the wires 76, which wires normally carry 8 to 12, and preferably 10, milliamperes. The positively charged plates 41A–44A are preferably subjected to a potential of from 6 to 10 kilovolts, preferably about 7 kilovolts, and are subjected to from 6 to 10, and preferably about 8, milliamperes. The device of the present invention, when operating under these conditions, can efficiently clean up to 3500 cubic feet of air per minute. Further, it is able to effectively clean the air while utilizing much less energy than an air cleaner using afterburners and the like.

MODIFICATIONS

Figure 9:
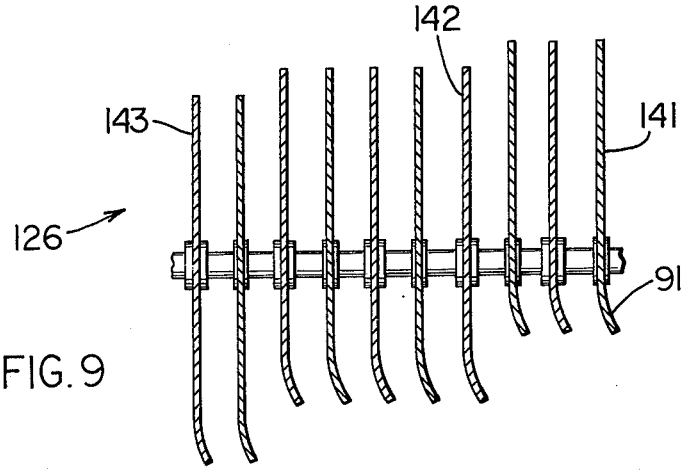
FIG. 9 illustrates therein a portiom of a modified rotor structure for the precipitator.

FIG. 9 illustrates a modified rotor 126 which can be used in place of the rotor 26 illustrated in FIG. 2. The modified rotor 126 is identical to the rotor 26 in that it includes a plurality of collector plates which are of progressively decreasing inside and outside diameters. FIG. 9 illustrates therein only a few of the collector plates, which have been designated 141, 142 and 143. The rotor 126 differs from the rotor 26 in that the radially inner edge of the ringlike collector plates are formed with a curved portion 91 which projects toward the inlet opening of the precipitator. The curved portion 91 assists in causing the air to be deflected radially outwardly so as to flow between the oppositedly charged collector plates, and in addition the curved portion strengthens the collector plate so that rather large plates can be formed from extremely thin sheet material while still possessing substantial strength and durability. The collector plates of the present invention are preferably formed from aluminum, aluminized steel, steel or copper, and may have a thickness of approximately 0.05 inch.

Figure 10:
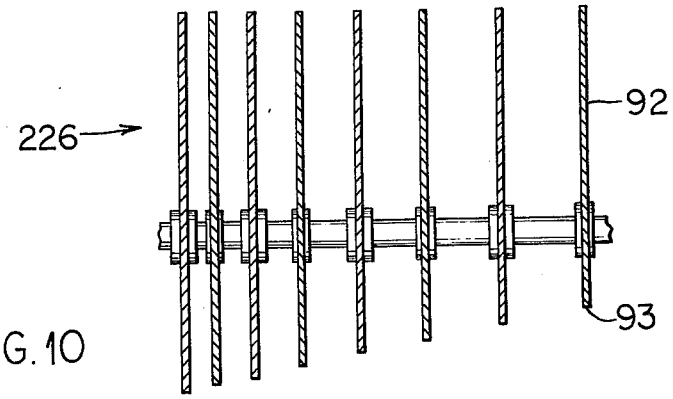
FIG. 10 is a fragmentary view of a further modified rotor structure for the precipitator.

FIG. 10 illustrates a further modified rotor 226 which is formed from a plurality of collector plates 92, which plates are all of equal outer diameter. However, the collector plates 92 have openings 93 therein which are of progressively decreasing diameter as the rotor extends from the inlet opening of the pecipitator. The rotor 226 thus has a central space which is of a uniform tapered configuration. This tapered configuration tends to equalize the resistance so that some of the inflowing air will be forced to flow outwardly through the collector plates adjacent the inlet end of the rotor. However, since the plates of the rotor 226 have different surface area, and inasmuch as the same potential is applied to each charged plate, the electrostatic field between each adjacent pair of oppositely charged plates will be different due to the different surface areas involved. Thus, to compensate for this difference, the rotor 226 has the plates of adjacent pairs spaced apart by a distance which progressively decreases as the plates extend from the inlet end to the closed end of the rotor. This progressively decreasing spacing results in substantially equal electrostatic fields between each adjacent pair of collector plates.

The rotor 26 of FIG. 2, or the rotor 126 of FIG. 9, is preferred since the rotor is able to provide for substantially equal flow of air between each pair of adjacent collector plates. At the same time, the progressively decreasing outside diameters of the plates results in equal areas on all of the the plates so that substantially uniform electrostatic fields are created by each pair of adjacent plates. Further, this stepped configuration on both the inside and outside diameters greatly simplifies the manufacture and assembly of the rotor and also minimizes the cost thereof since only a limited number of different plates must be provided, with a plurality of each different plate being utilized. This is in contrast to a rotor wherein all of the plates are of constant outside diameter but each individual plate is provided with a different inside diameter, since this latter type of rotor has greatly increased manufacturing complexity and cost due to the need to provide a large number of different plates, and due to the extreme care which must be exercised to ensure that all of the plates are individually assembled in the proper sequence.

The present invention encompasses a rotor formed from a plurality of collector plates which have the inside and outside diameters thereof progressively decreasing from one end of the rotor to the other end thereof so that both the inside and outside profiles of the rotor are of a truncated conical configuration. Thus, all of the plates will still be of equal area, but each plate will have inside and outside diameters which are different from the inside and outside diameters of the adjacent plates.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an electrostatic precipitator apparatus including housing means having inlet and outlet opening means, a precipitator member disposed in the housing means and positioned in the flow path between said inlet and outlet opening means, the precipitator member having a plurality of annular, axially spaced apart, parallel collector plates, said collector plates each having a central opening therethrough, the central openings of said collector plates being aligned to define an axially elongated gas receiving space surrounded by said plurality of collector plates, said inlet opening means being disposed adjacent one end of said plurality of collector plates and in communication with the gas receiving space whereby a particle-laden gaseous stream can be supplied into said gas receiving space and then flow outwardly through channels defined between the collector plates for discharge through said outlet opening means, an end member disposed adjacent the other end of said plurality of plates for closing the other end of said space, ionizing means disposed within said inlet opening means for ionizing the particles in the gaseous stream flowing therethrough, means for electrically insulatedly supporting alternate ones of said collector plates from the others of said collector plates, and electrical connection means for supplying voltage to said alternate collector plates and said ionizing means, comprising the improvement wherein all of said collector plates have substantially equal surface areas and are substantially uniformly axially spaced apart so that electrostatic fields of substantially equal intensity are created between each adjacent pair of collector plates for removing the ionized particles from the gaseous stream as it flows outwardly through the channels defined between the collector plates, and wherein the central openings of said collector plates are of decreasing diameter as the plates extend from said one end thereof to the other end thereof so that said axially elongated gas receiving space decreases in cross-sectional area as it extends from said inlet opening means to said end member so that substantially uniform quantities of the gaseous stream flow outwardly through all of the channels.

2. A precipitator apparatus according to claim 1, wherein said plurality of collector plates includes several sets of collector plates with each set containing a plurality of identical plates, a first of said sets being disposed adjacent said inlet opening means, a second of said sets being disposed adjacent said end member, and a third of said sets being disposed between said first and second sets, the plates of said first set having inside and outside diameters which are larger than the respective inside and outside diameters of the plates of said third set, and the plates of said third set having inside and outside diameters which are larger than the respective inside and outside diameters of the plates of said second set.

3. A precipitator apparatus according to claim 1, wherein said ionizing means includes a plurality of spaced apart, parallel flow divider plates disposed within a plane which is transverse to the longitudinal axis of said plurality of collect plates and adjacent the inlet end of said gas receiving space, said ionizing means also including a plurality of substantially parallel and spaced apart ionizing wires, each of said wires being disposed parallel to and spaced substantially midway between a pair of said flow divider plates.

4. A precipitator apparatus according to claim 1, wherein said plurality of plates, at least adjacent the radially inner edge thereof, extend at a nonperpendicular angle with respect to the axial direction of said space.

5. A precipitator apparatus according to claim 1, wherein the outer diameter of at least some of said collector plates decreases in size as the plates extend from said inlet opening means toward said end member.

6. A precipitator apparatus according to claim 5, including drive means connected to said precipitator member for rotating same about the axis of said plurality of collector plates.

7. A precipitator apparatus according to claim 6, wherein said housing means has a substantially cylindrical sidewall which surrounds said precipitator member and is substantially coaxially aligned with the rotational axis thereof, said housing means having said inlet opening means and said outlet opening means formed in the opposite ends thereof in substantial axial alignment with one another and coaxially aligned with the rotational axis of said precipitator member.

8. A precipitator apparatus according to claim 5, including rotatable shaft means aligned with the axis of said plurality of collector plates, means fixedly connecting said plurality of collector plates to said shaft means for rotation therewith, and drive means connected to said shaft means for rotating same.

9. A precipitator apparatus according to claim 8, wherein said plurality of collector plates includes several sets of collector plates with each set containing a plurality of identical plates, a first of said sets being disposed adjacent said inlet opening means, a second of said sets being disposed adjacent said member, and a third of said sets being disposed between said first and second sets, the plates of said first set having inside and outside diameters which are larger than the respective inside and outside diameters of the plates of said third set, and the plates of said third set having inside and outside diameters which are larger than the respective inside and outside diameters of the plates of said second set.

* * * * *